US006719093B2

(12) United States Patent
Garbs

(10) Patent No.: US 6,719,093 B2
(45) Date of Patent: Apr. 13, 2004

(54) EXTENSION LADDER AND TREE STAND

(76) Inventor: Michael R. Garbs, 2922 Prairie Grass Dr., O'Fallen, MO (US) 63366

( * ) Notice: Subject to any disclaimer, the term of this patent is extended or adjusted under 35 U.S.C. 154(b) by 0 days.

(21) Appl. No.: 10/062,240

(22) Filed: Feb. 1, 2002

(65) Prior Publication Data

US 2003/0146048 A1 Aug. 7, 2003

(51) Int. Cl.[7] ..... E06C 7/16

(52) U.S. Cl. ..... 182/116; 182/93; 182/100; 182/163

(58) Field of Search ..... 182/93, 100, 116, 182/187, 189, 195, 207

(56) References Cited

U.S. PATENT DOCUMENTS

| | | | | | |
|---|---|---|---|---|---|
| 3,861,500 | A | * | 1/1975 | Dempsey | 182/204 |
| 3,968,858 | A | * | 7/1976 | Vollan et al. | 182/135 |
| 4,022,292 | A | | 5/1977 | Van Gompel | |
| 4,061,202 | A | | 12/1977 | Campbell | |
| 4,257,490 | A | | 3/1981 | Bandy | |
| 4,411,335 | A | | 10/1983 | Forrester | |
| 4,552,246 | A | | 11/1985 | Thomas | |
| 4,592,446 | A | | 6/1986 | White | |
| 4,787,476 | A | | 11/1988 | Lee | |
| 5,040,635 | A | * | 8/1991 | Strickland | 182/100 |
| 5,253,732 | A | | 10/1993 | Daniels | |
| 5,439,072 | A | | 8/1995 | Jenkins, Jr. | |
| 5,454,445 | A | | 10/1995 | Berryman | |
| 5,655,623 | A | | 8/1997 | Skyba | |
| 5,752,580 | A | | 5/1998 | Jenkins, Jr. | |
| 5,779,208 | A | * | 7/1998 | McGraw | 248/238 |
| 5,806,626 | A | * | 9/1998 | Jenkins, Jr. | 182/100 |
| 5,857,542 | A | * | 1/1999 | Mason | 182/92 |
| 6,073,726 | A | * | 6/2000 | McCrystal | 182/195 |
| 6,170,609 | B1 | * | 1/2001 | Dech | 182/187 |
| 6,305,497 | B1 | * | 10/2001 | Simon | 182/100 |
| 6,340,071 | B1 | * | 1/2002 | Diekemper | 182/100 |
| 6,547,035 | B1 | * | 4/2003 | D'Acquisto | 182/100 |

* cited by examiner

*Primary Examiner*—Bruce A. Lev
(74) *Attorney, Agent, or Firm*—John V. Stewart

(57) ABSTRACT

An extension ladder and tree stand for supporting a seated or standing person on an elevated platform against a tree trunk for hunting, photography, and the like. The ladder and platform collapse into a compact size and shape for carrying by a person. The ladder is in telescoping sections. Alternate steps of the ladder slide to the middle of each telescoping section. This provides twice as many steps as sections, reducing the number of telescoping sections by half. This minimizes weight, size, complexity, and expense. When deployed, all parts remain safely assembled in all positions. Captive spring loaded pins fix the telescoping sections in extended or retracted positions, and fix the sliding steps in a middle position of each section. A folding seat on the platform has a cushion that reconfigures into a back cushion for carrying the collapsed assembly on the back of a person.

10 Claims, 4 Drawing Sheets

EXTENSION LADDER AND TREE STAND

BACKGROUND OF THE INVENTION

1. Field of the Invention

This invention relates to portable extension ladders, especially those with an attached elevated tree stand and/or seat for hunters, photographers, and the like, that collapse for carrying on the back of a person.

2. Description of Prior Art

Numerous portable extension ladders and folding tree stands are shown in prior patents such as the following examples:

U.S. Pat. No. 5,454,445 (Berryman 1995)

U.S. Pat. No. 5,752,580 (Jenkins, Jr 1998)

U.S. Pat. No. 5,655,623 (Skyba 1997)

U.S. Pat. No. 4,592,446 (White 1986)

U.S. Pat. No. 5,439,072 (Jenkins, Jr 1995)

U.S. Pat. No. 5,253,732 (Daniels 1993)

U.S. Pat. No. 4,787,476 (Lee 1988)

U.S. Pat. No. 4,552,246 (Thomas 1985)

U.S. Pat. No. 4,422,335 (Forrester 1983)

U.S. Pat. No. 4,257,490 (Bandy 1981)

U.S. Pat. No. 4,061,202 (Campbell 1977)

U.S. Pat. No. 4,022,292 (Van Gompel)

However, none of the prior inventions have the unique features of the present invention. None of them have a step that slides to the middle of each telescoping section to reduce the number of sections by half, and none have a seat pad that reconfigures into a back pad as in the present device.

SUMMARY OF THE INVENTION

The objectives of the present invention are provision of a lightweight, compact, portable ladder and tree stand for supporting a seated or standing person in an elevated position against a tree trunk for hunting, photography, and the like. Further objectives are ease of installation, ease of collapsing for carrying, safety, comfort in the stand and while carrying the device, and minimum expense.

These features are provided by an extension ladder and tree stand for supporting a seated or standing person on an elevated platform against a tree trunk for hunting, photography, and the like. The ladder and platform collapse into a compact size and shape for carrying by a person. The ladder is in telescoping sections. Alternate steps of the ladder slide to the middle of each telescoping section. This provides twice as many steps as sections, reducing the number of telescoping sections by half. This minimizes weight, size, complexity, and expense. When deployed, all parts remain safely assembled in all positions. Captive spring loaded pins fix the telescoping sections in extended or retracted positions, and fix the sliding steps in a middle position of each section. A folding seat on the platform has a cushion that reconfigures into a back cushion for carrying the collapsed assembly on the back of a person.

REFERENCE NUMBERS

Figure 1:
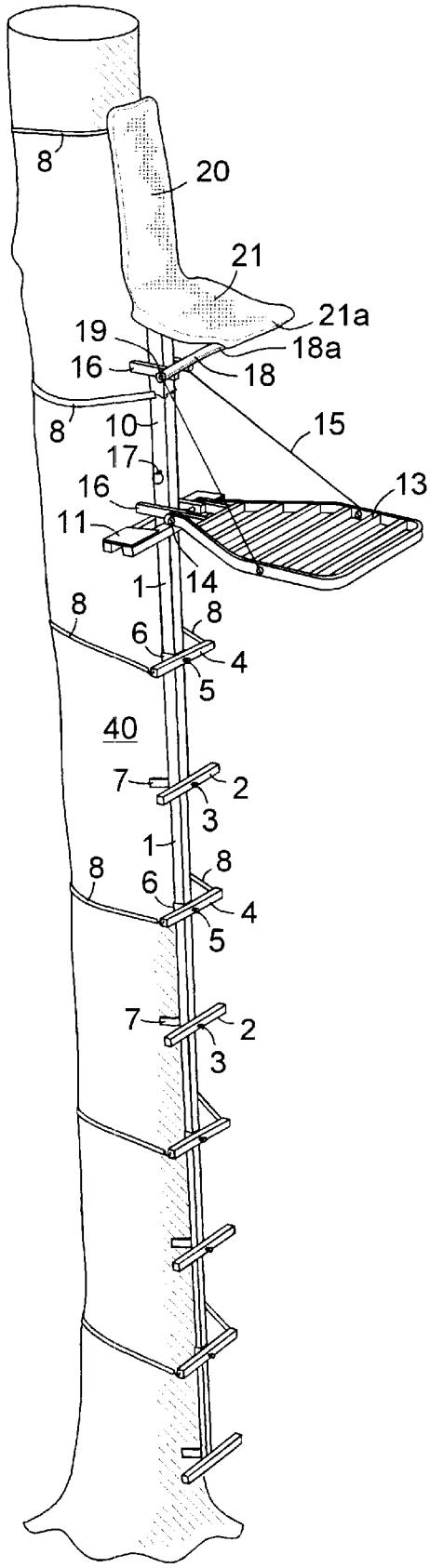
FIG. 1 is a perspective frontal view of the invention installed against a tree.

1. Tubular section of extension ladder
2. Fixed step or rung on section of extension ladder
3. Spring loaded pin for locking a telescoping section in retracted or extended position
4. Sliding step or rung on section of extension ladder
5. Spring loaded pin for locking a sliding step in deployed position
6. Sliding tube portion of sliding step
7. Tree trunk contact bracket
8. Tree trunk strap
9. Tree trunk strap connection hole
10. Main vertical support tube of platform and seat
11. Platform step on lower end of platform support tube
12. Spring
13. Platform
14. Pivot attachment of platform
15. Tether line of platform
16. Tree trunk contact bar
17. Collapsed extension tubes lock pin
18. Seat frame
18*a*. Distal end of seat frame
19. Pivot attachment of seat frame
20. Back portion of seat pad
21. Bottom portion of seat pad
21*a*. Distal end of bottom portion of seat pad
22. Seat bottom suspension attachment loop
23. Seat bottom anchor bar
24. Seat back tie cord
26. Pinhole for locking section extended
27. Pinhole for locking section retracted
28. Pin hole for locking sliding step at middle of section
31. Main vertical support tube of ladder extension
32. Step on ladder extension
33. Spring loaded pin on ladder extension option
40. Tree trunk

DETAILED DESCRIPTION

Figure 2:
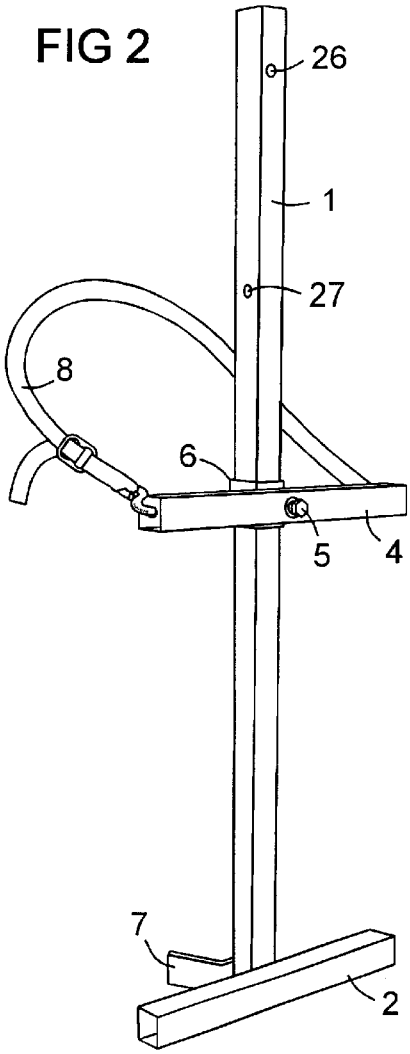
FIG. 2 is a perspective frontal view of the lowest extension section of the ladder in the installed configuration.
Figure 3:
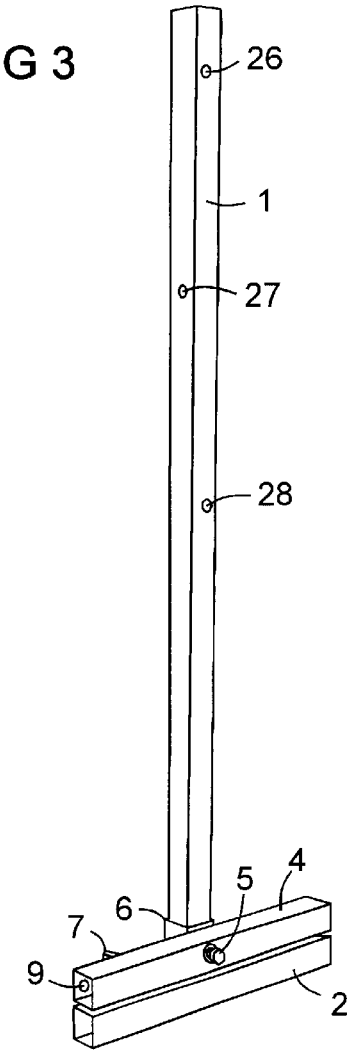
FIG. 3 is a perspective frontal view of the lowest extension section of the ladder in retracted configuration.
Figure 4:
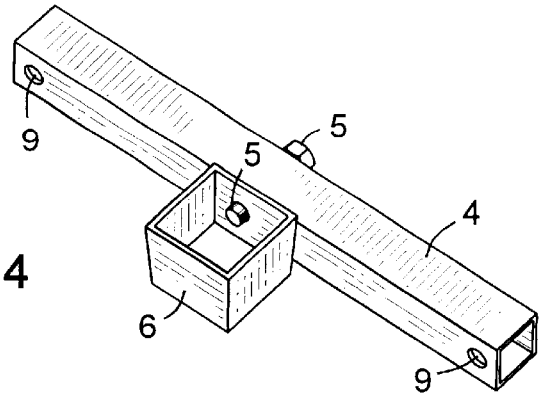
FIG. 4 is a perspective top back view of a sliding step of the ladder.
Figure 5:
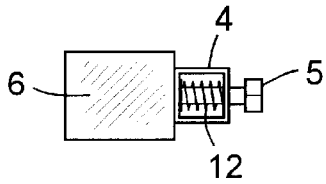
FIG. 5 is a side view of a sliding step of the ladder.
Figure 7:
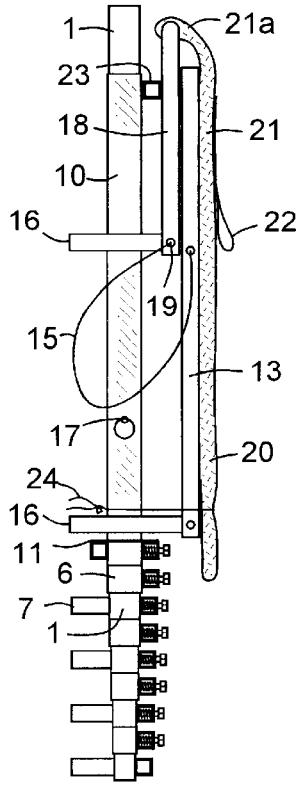
FIG. 7 is a side view as in FIG. 6 in the retracted/collapsed configuration.
Figure 9:
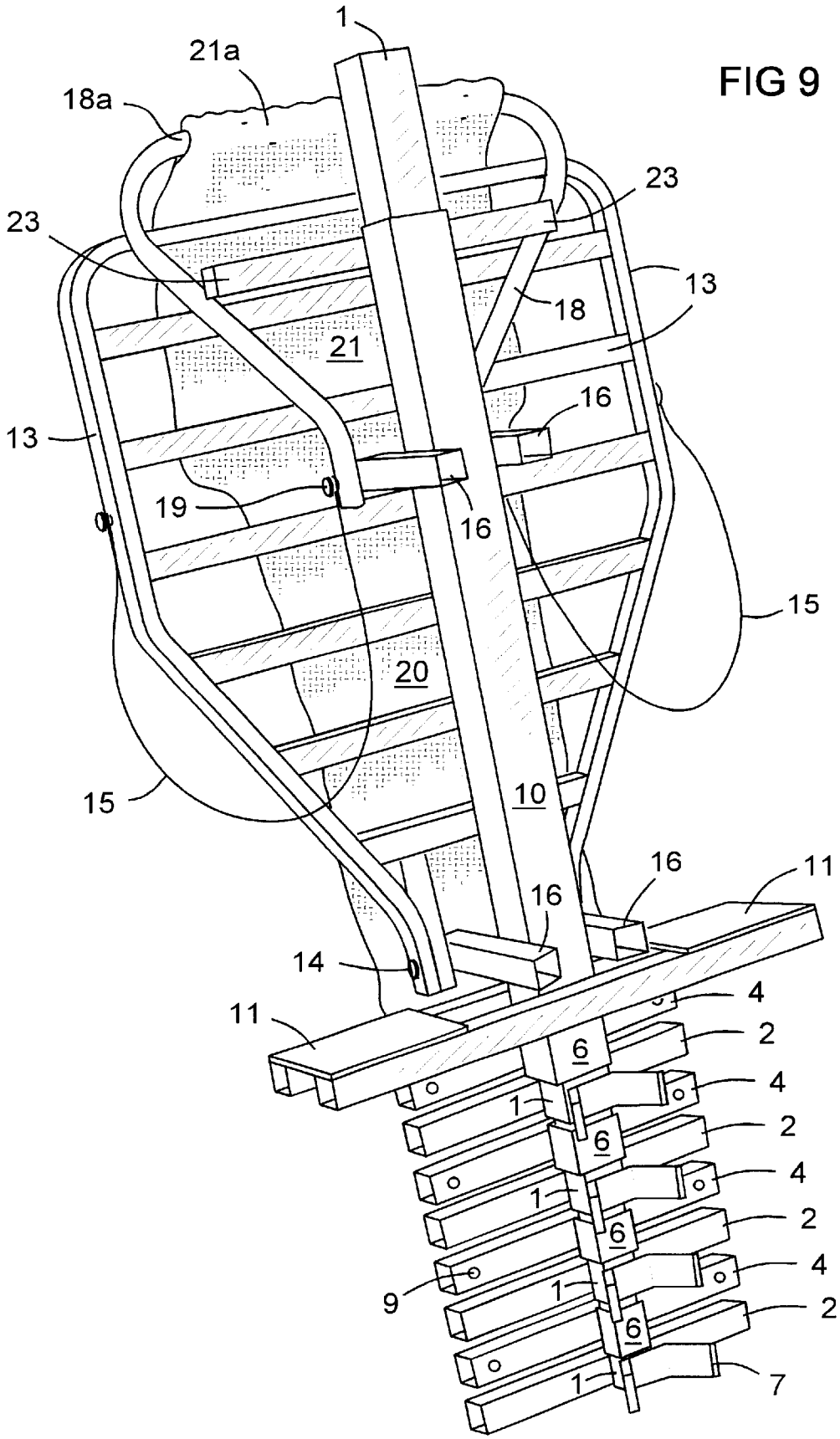
FIG. 9 is a perspective back view of the folded ladder and stand assembly.

The present invention provides a uniquely compact extension ladder via a telescoping series of nested tubes with slidable steps. As shown in FIGS. 2 and 3, each nested tube 1 has a fixed bottom step 2 and at least one slidable middle step 4. The middle step is fixed at a midpoint on the tube 1 by a spring-loaded pin 5, as shown in FIGS. 4 and 5. The pin 5 is urged inward by a compression spring 12 to engage a hole 28 in the tube 1 seen in FIG. 3. The pin is manually released to slide the middle step downward against the fixed step. In this position, the nested tube 1 can be retracted into the next larger tube as seen in FIGS. 7 and 9.

A slidable middle step and a fixed step are mounted on each nested tube section. Thus, each nested tube section provides two extendable steps, yet the steps can be retracted as if each step had its own nested tube section. One advantage of the sliding step is that it reduces by half the number of nested tube sections needed for a given ladder length, greatly reducing the weight, expense, and complexity of the ladder. More than one slidable step can be provided on each nested tube section, but there is a trade-off in longer tube sections, so the preferred embodiment is one slidable step per nested tube section.

A second advantage of the sliding step concept is reduction by half the number of nested section interconnections, and thus the resulting cumulative play in the ladder. The nested tubes are preferably releasably fixed in an extended position by means of a spring-loaded pin 3 in each fixed step 2, similar to that used in the sliding steps. Since the cumulative intersection play is reduced by half, it is possible to use pin type slide stops for applications requiring moderate lateral rigidity, depending on the number of sections versus the section length. These are product design tradeoffs as previously mentioned.

Other types of telescoping section locking devices can be used. For example, in addition to a pin, a cam/lever can be provided that pushes a smaller tube laterally against an interior corner line of the next larger tube to eliminate play. Such a cam type mechanism provides rigidity between extended sections for leaning the ladder against a wall or other object.

As shown in FIGS. 2 and 3, a hole 26 near the top of each section receives the section locking pin 3 of the next larger section in the extended position of the sections. Preferably, a single pin 17 on the largest tube locks all nested tubes in the retracted position via a hole 27 in each tube. Alternately, each nested tube can have two locking holes: one for the extended position, and one for the retracted position. Preferably the locking pins and holes for the sliding steps are laterally offset from the locking pins and holes for the sections. For example, the step locking pins can be offset ¼" to the right and the section locking pins can be offset ¼" to the left of the centerline of the telescoping sections. This prevents the section locking pins from falling into the holes for the sliding steps.

Optionally, two parallel sets of nested tubes can be used. In this case, each section comprises two parallel tubes with steps spanning between them. Again, one fixed step and one or more sliding steps is provided per section. For the application shown here, a single series of nested tubes is preferred to minimize weight and expense, as shown in all the drawings. An extension ladder according to this invention can be used in any extension ladder application. It is especially useful where weight and/or space is/are critical.

Figure 6:
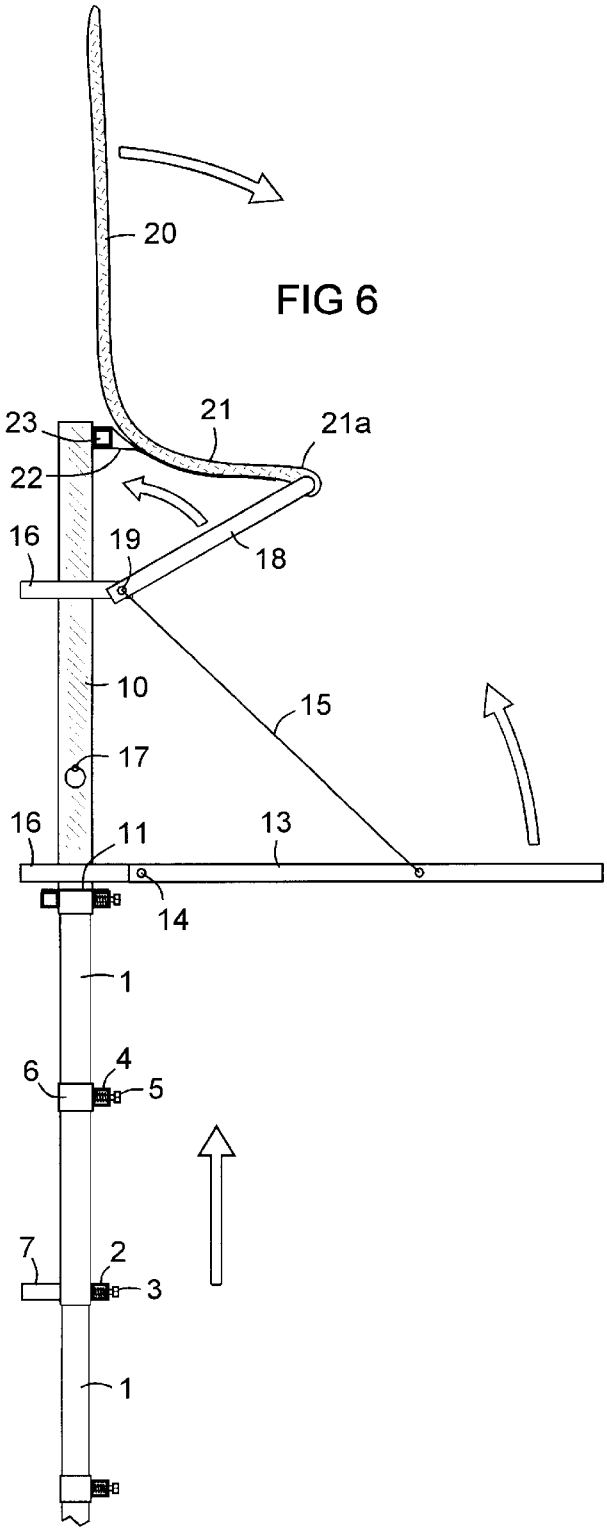
FIG. 6 is a side view of the platform and seat assembly in the installed configuration.
Figure 8:
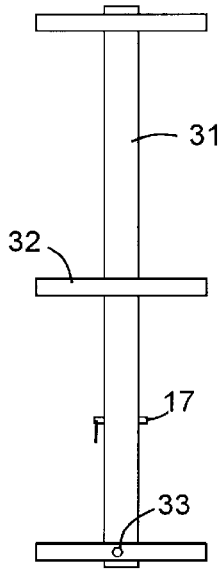
FIG. 8 is a front view of an optional ladder extension to be used as the top section of the ladder in place of the platform/seat assembly.

The top section of the ladder is provided either with steps, as in FIG. 8, or with a platform as shown in FIGS. 1, 6, 7, and 9. In FIG. 8, the top section of the ladder has three fixed steps. The bottom step of FIG. 8 can optionally be wider than the other steps to encourage a user to stand on the wide step while gripping the top step. The top step may optionally include tool and paint support means for general household applications The preferred embodiment of the top section is a folding platform as shown best in FIGS. 1, 6, 7, and 9. This platform provides an elevated stand for hunters or nature photographers. The preferred top section also includes a seat made of padded fabric that converts to a back pad for backpacking the collapsed stand, seat, and ladder. Conversion of the platform/seat for backpacking is shown in FIG. 6, with arrows indicating the direction of folding of the elements.

FIG. 7 shows the result of folding and collapsing per the arrows of FIG. 6. The seat material of FIG. 6 is against the bottom of the folded platform 13, which supports the seat material evenly for comfort against a user's back. Appropriate shoulder straps are permanently or removably attached to the platform/seat assembly.

In the preferred embodiment as a tree stand, straps 8 and tree trunk contact points 7 and 16 are preferably provided as shown. The lengths of the straps are adjustable with a buckle mechanism on each strap. The strap and tree trunk contact elements need not be designed specifically as shown. For example, tree trunk contact brackets 7 could optionally be mounted on the slidable tube portion 6 of each sliding step 4. In the preferred design, straps 8 are connected via end hooks to holes 9 in each sliding step and to holes in the top section 10. A tree trunk contact bracket is provided on each nested tube section opposite the fixed step, where it does not interfere with section retraction.

Although the present invention has been described herein with respect to preferred embodiments, it will be understood that the foregoing description is intended to be illustrative, not restrictive. Modifications of the present invention will occur to those skilled in the art. All such modifications that fall within the scope of the appended claims are intended to be within the scope and spirit of the present invention.

CLAIM TERMINOLOGY

First, Second: In the claims it helps to visualize the "first" as the lowest, and the "second" as being next higher. This places the largest tubular section on top, as shown in the drawings. However, when the largest tubular section only has steps as in FIG. 8, the extension ladder can be used in either vertical orientation, with the largest section at the top or bottom.

I claim:

1. A portable extension ladder comprising:

a single central support mast;

a first elongated tubular section of the mast having an interior, an exterior, a top end, and a bottom end;

a second elongated tubular section of the mast having a top end, a bottom end, an interior, and an exterior, the exterior having front and back sides;

the first tubular section slidably nested in the interior of the second tubular section and extending from the bottom end of the second tubular section;

a section slide stopping mechanism that releasably fixes the first tubular section in an extended position from the second tubular section;

a bottom step mounted on the bottom end of the first tubular section;

a middle step slidably captured on the exterior of the first tubular section between the bottom step and the top end of the first tubular section; and a middle step slide stopping mechanism that releasably fixes the middle step at an intermediate position on the first tubular section between the bottom step and the top end of the first tubular section.

2. The portable extension ladder of claim 1, further comprising at least one additional tubular section sequentially nested telescopically within, and extending below, the first elongated tubular section, each said additional section having a section slide stopping mechanism, a fixed bottom step, a slidable middle step, and a middle step slide stopping mechanism.

3. The portable extension ladder of claim 1, wherein the section slide stopping mechanism comprises a captive, spring-loaded pin in the bottom step and a matching pinhole in the top end of the first tubular section; wherein the middle step slide stopping mechanism comprises a captive, spring-loaded pin in the middle step and a matching pinhole at a midpoint in the first tubular section; and wherein the section slide stopping mechanism is laterally offset from the middle step slide stopping mechanism.

4. The portable extension ladder of claim 1, further comprising:

a platform step mounted on the bottom end of the second tubular section;

a platform pivotally mounted on the second tubular section;

a tether for retaining the platform against gravity in a position substantially normal to the second tubular section;

a seat frame pivotally mounted on the second tubular section above the platform, and having a distal end;

a seat suspension anchor attached to the second tubular section above the seat frame;

a seat pad having a back portion and a bottom portion;

the bottom portion of the seat pad having a distal end attached to the distal end of the seat frame; and the bottom portion of the seat pad having a proximal end with releasable attachment to the seat suspension anchor.

5. The portable extension ladder of claim 1 wherein the second tubular section has at least two fixed steps.

6. A portable extension ladder comprising:

a single central support mast;

first and second elongated tubular sections of the mast, each section having an interior, an exterior, and first and second ends;

the first section slidably nested in the interior of the second section for telescoping extension of the first section from the first end of the second section;

a section slide fixing mechanism that releasably fixes the first section in the second section selectably in either an extended or retracted position of the first section relative to the second section;

a first step fixed to the first end of the first section;

a second step slidably captured on the exterior of the first section; and a second step slide fixing mechanism that releasably fixes the second step on the first section at a position between the first and second ends of the first section;

whereby the first section, when in an extended position, provides two spaced steps, and, when in a retracted position, nests mostly inside the second section.

7. The portable extension ladder of claim 6 further comprising at least one additional tubular section sequentially nested telescopically within, and extending from, the first elongated tubular section, each said additional section having a section slide fixing mechanism, a fixed first step, a slidable second stop, and a second step slide fixing mechanism.

8. The portable extension ladder of claim 6, wherein the section slide fixing mechanism comprises a captive, spring-loaded pin in the first step and a matching pinhole in the top end of the first tubular section; wherein the second step slide fixing mechanism comprises a captive, spring-loaded pin in the second step and a matching pinhole at a midpoint in the first tubular section; and wherein the section slide fixing mechanism is laterally offset from the second step slide fixing mechanism.

9. The portable extension ladder of claim 6 having a folding seat attached to the second section, comprising:

a third step fixed to the first end of the second section;

a platform pivotally attached to the second section between the third step and the second end of the second section, the platform having a pivot axis;

a tether for restraining the platform against gravity at a pivotal position of the platform approximately normal to the second section;

a rigid seat support frame pivotally attached to the second section between the platform and the second end of the second section, the support frame having a pivot axis and a distal portion;

the pivot axes of the platform and the seat support frame approximately parallel;

a seat suspension stay in the form of a bar attached to the second section between the seat support frame and the second end of the second section;

a elongated generally flat seat pad having a bottom portion and a back portion;

the seat bottom portion having a distal end mounted on the distal portion of the support frame;

the seat bottom portion having a proximal end with suspension loops for mounting over the suspension stay.

10. The portable extension ladder of claim 6 wherein the second tubular section has at least two fixed steps.

* * * * *